US010077130B1

(12) United States Patent
Fron et al.

(10) Patent No.: US 10,077,130 B1
(45) Date of Patent: Sep. 18, 2018

(54) CORRUGATED CONTAINER WITH INTEGRATED TOP HANDLE

(71) Applicants: Champion Container Corp., Wood Dale, IL (US); Standfast Group, LLC, Carol Stream, IL (US)

(72) Inventors: Keith Fron, Orland Park, IL (US); Scott Moore, Batavia, IL (US)

(73) Assignees: Champion Container Corp., Wood Dale, IL (US); Standfast Group, LLC, Carol Stream, IL (US)

( * ) Notice: Subject to any disclaimer, the term of this patent is extended or adjusted under 35 U.S.C. 154(b) by 0 days.

(21) Appl. No.: 15/652,885

(22) Filed: Jul. 18, 2017

(51) Int. Cl.

| | |
|---|---|
| ***B65D 5/46*** | (2006.01) |
| ***B65D 5/66*** | (2006.01) |
| ***B65D 5/42*** | (2006.01) |
| ***B65D 5/02*** | (2006.01) |

(52) U.S. Cl.
CPC ..... *B65D 5/46096* (2013.01); *B65D 5/02* (2013.01); *B65D 5/4266* (2013.01); *B65D 5/46112* (2013.01); *B65D 5/6605* (2013.01)

(58) Field of Classification Search
CPC .... B65D 5/46096; B65D 5/02; B65D 5/4266; B65D 5/46112; B65D 5/6605; B65D 5/4208; B65D 5/46128; B65D 5/4616
USPC ..... 229/117.14, 103; 206/169
See application file for complete search history.

(56) References Cited

U.S. PATENT DOCUMENTS

| | | | | |
|---|---|---|---|---|
| 1,956,619 | A * | 5/1934 | McAleer | B65D 5/46096 229/117.15 |
| 1,982,962 | A * | 12/1934 | McAleer | B65D 5/46128 229/117.14 |
| 4,134,534 | A * | 1/1979 | Scott | B65D 5/46096 229/117.15 |
| 8,939,351 | B2 * | 1/2015 | Goudreau | B65D 77/065 222/105 |
| 2017/0183119 | A1 * | 6/2017 | Choi | B65D 5/10 |

FOREIGN PATENT DOCUMENTS

| | | | |
|---|---|---|---|
| JP | 40-26781 | * | 9/1965 |

* cited by examiner

*Primary Examiner* — Christopher Demeree
(74) *Attorney, Agent, or Firm* — Erickson Law Group, PC

(57) ABSTRACT

A corrugated container is disclosed having a plurality of walls, an interior cargo space, and a top panel. The plurality of walls define the interior cargo space. The top panel comprises a handle and a handle aperture. The top panel is disposable over the cargo space. The handle comprises a raised position and a stored position. The handle is housed within the handle aperture when in the stored position. The handle extends out of the handle aperture and is transverse to the top panel when in the raised position.

19 Claims, 10 Drawing Sheets

CORRUGATED CONTAINER WITH INTEGRATED TOP HANDLE

FIELD OF THE INVENTION

The present invention relates to corrugated containers.

BACKGROUND

Containers are known for storing and transporting items. One type of container is made from corrugated fiberboard. Some containers require a user to use both of the user's hands to lift the container, typically from opposite sides.

The present inventors recognized a need for a container that is easy to carry. The present inventors recognized a need for a container that has a handle extending from the top of the container. The present inventors recognized the need for a container with a handle positioned so that the container could be carried with one hand. The present inventors recognized the need for a container with top centrally located handles. The present inventors recognized the need for a container with a handle embedded in the top panel of the container. The present inventors recognized the need for container with a handle that can be compactly stored when not in use. The present inventors recognized the need for a container with the handle formed in a top panel of the container. The present inventors recognized the need for a handle that can be formed of the same material as the container.

SUMMARY

A corrugated fiberboard container is disclosed having a plurality of walls, an interior cargo space, and a top panel. The plurality of walls define the interior cargo space. The top panel comprises a handle and a handle aperture. The top panel is disposable over the cargo space.

The handle comprises a raised position and a stored position. The handle is housed within the handle aperture when in the stored position. The handle extends out of the handle aperture and is transverse to the top panel when in the raised position.

In some embodiments the top panel or a second top panel comprises a second handle and a second handle aperture. The second handle comprises a raised position and a stored position. The second handle is housed within the handle aperture when in the stored position. The second handle extends out of the handle aperture and is transverse to the top panel or second top panel when in the raised position.

Numerous other advantages and features of the present invention will become readily apparent from the following detailed description of the invention and the embodiments thereof, from the claims, and from the accompanying drawings.

DETAILED DESCRIPTION OF THE EMBODIMENTS

Figure 1:
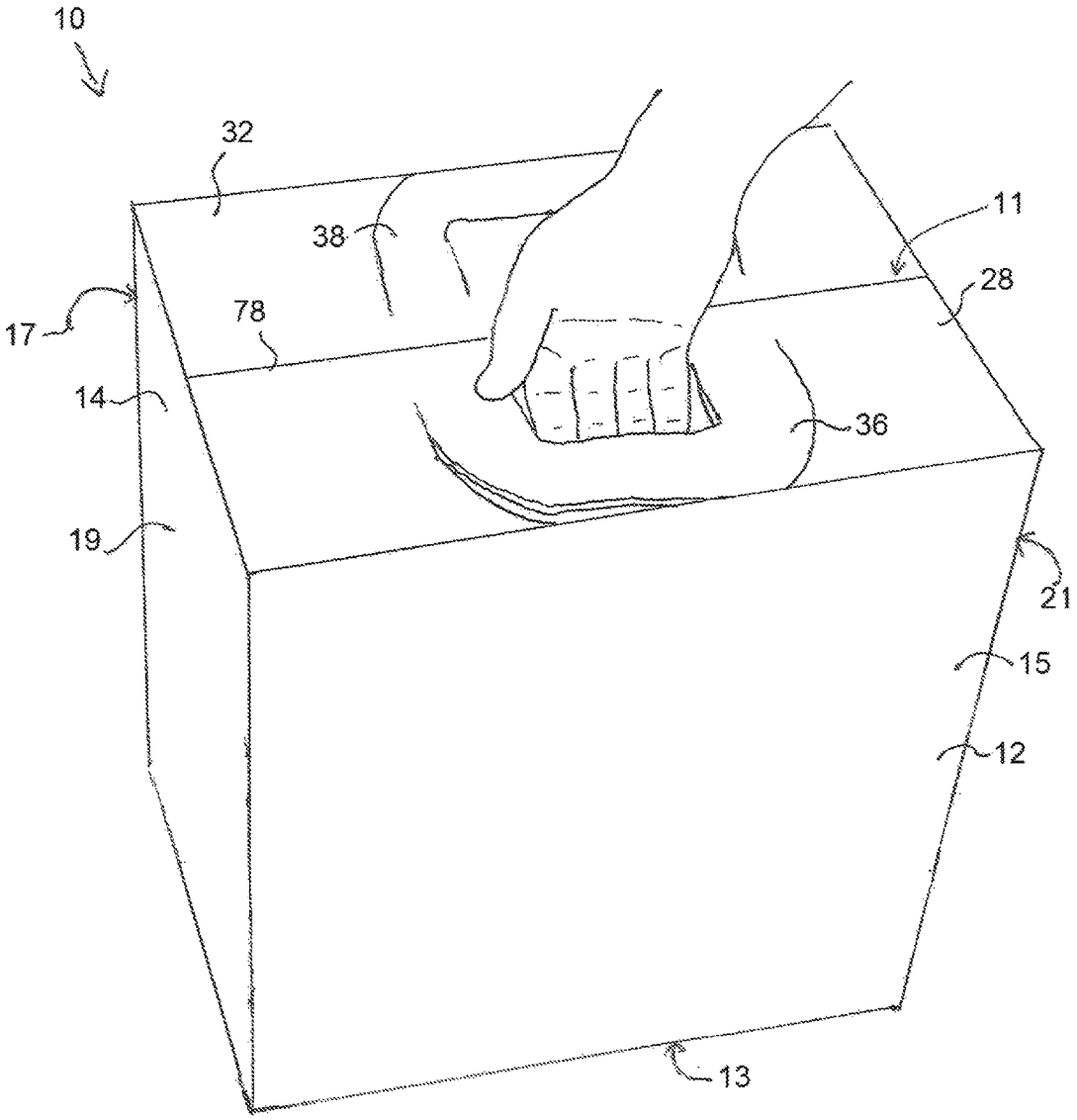
FIG. 1 is a perspective view of a container according to a first embodiment of the present disclosure.

The following description is presented to enable any person skilled in the art to make and use the invention. For the purposes of explanation, specific nomenclature is set forth to provide a plural understanding of the present invention. While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

A container, shown as a box, comprising handles according to a first embodiment of the present disclosure is illustrated in FIGS. 1 through 5. The box 10 comprises an interior cargo area, a top side 11, a bottom side 13, a front side 15, a back side 17, a left side 19, and a right side 21. The front side comprises a front panel 12. The backside 17 comprises a back panel 16. The left side 19 comprises a left panel 14. The right side 21 comprises a right panel 18. While sides 15, 17, 19, 21 are labeled front side, backside, left side, and right side, respectively, it will be recognized that other designations for those sides are allowed. For example, what has been labeled front side could be considered the backside and all other sides relabeled accordingly. As a further example, what has been labeled the left side could be considered the front side and all other sides relabeled accordingly. Therefore, the user or the application or the particular box configuration can determine whether or not a particular side is labeled a front side, a backside, a left side, or a right side.

Figure 2:
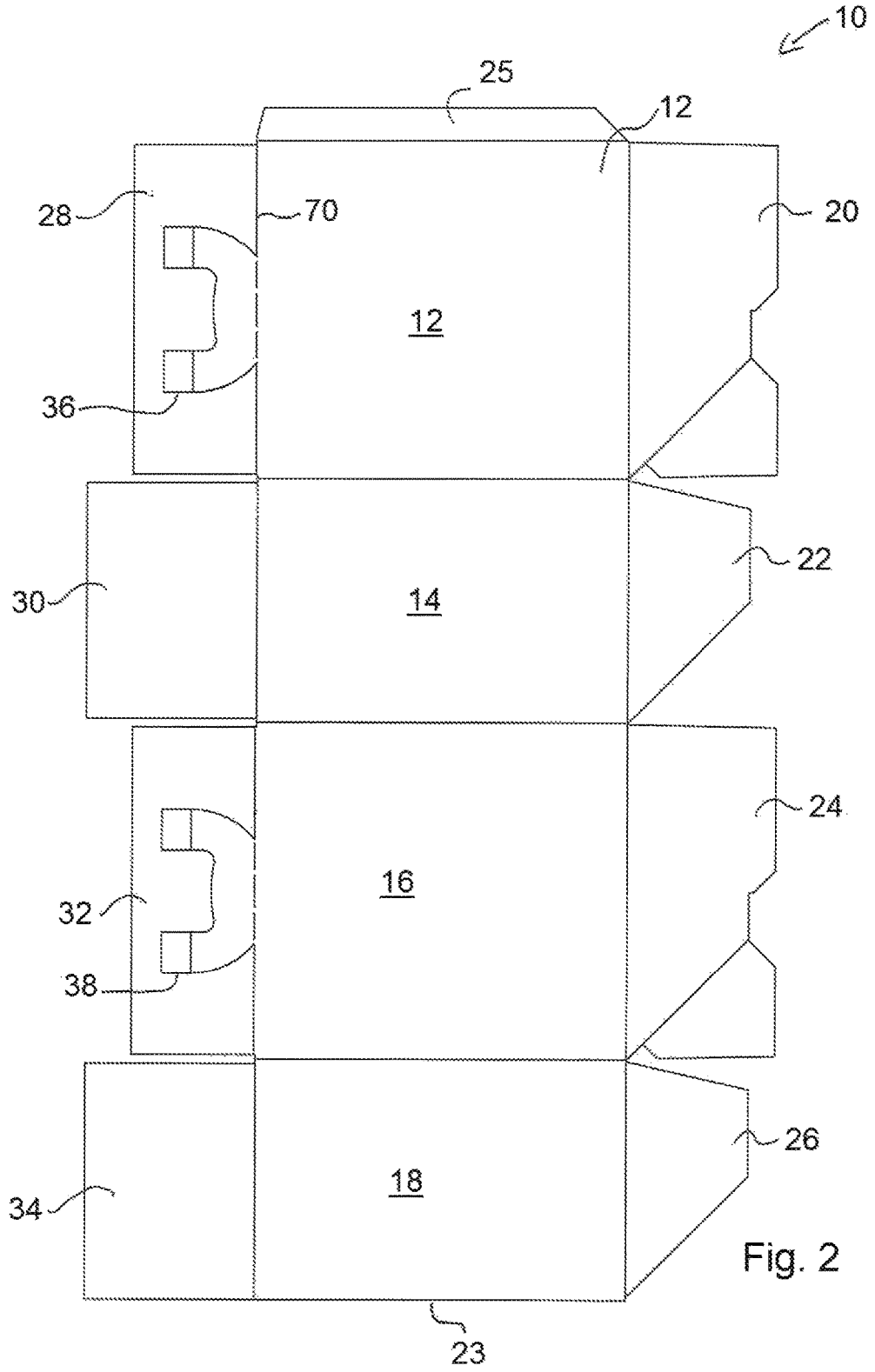
FIG. 2 is a top view of the container of FIG. 1 in a flat configuration.

FIG. 2 shows the box 10 in a flat configuration where panel 12 has been disconnected from panel 18. To convert the box from the flat configuration to a box configuration the tab 25 may be affixed to an inside surface or an outside surface of the panel 18 at or adjacent edge 23. The bottom panels 22, 26, 20, 24 are folded down, typically until the bottom panels are substantially perpendicular to the side walls of the box. The bottom side 13 comprises the first bottom panel 20 and a second bottom panel 24. Third bottom panel 22 and forth bottom panel 26 may be folded under bottom panel 20 and bottom panel 24 to provide support to panels 20 and 24. In some embodiments, all of or a portion of panels 22 and 26 are visible from the bottom when the boxes in the box configuration. It will be recognized that panels 20, 22, 24, 26, could be square or rectangular rather than the shapes shown in FIG. 2.

Figure 4:
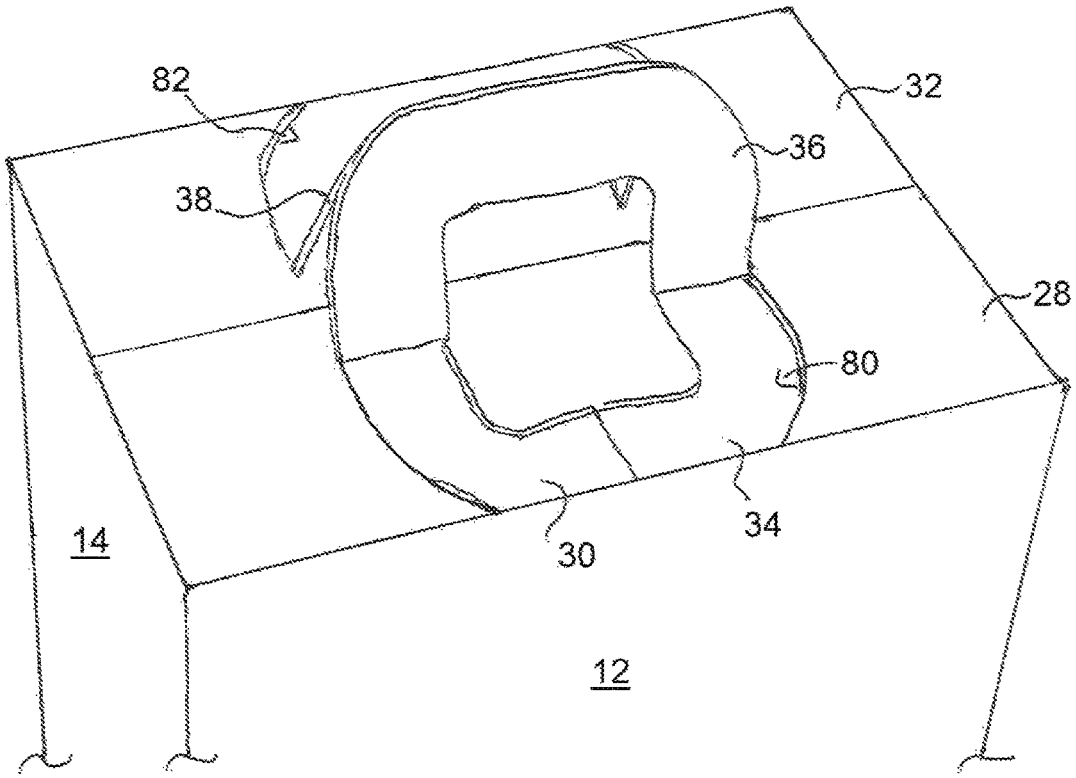
FIG. 4 is a top perspective view of the container of FIG. 1 comprising handles in a raised position.

The top side 11 comprises a first top panel 28 and a second top panel 32. As shown in FIG. 4, when the box is in a box configuration a third top panel 30 and a forth top panel 34 are located beneath the first top panel 28 and the second top panel 32.

The first top panel 28 comprises a first top handle 36. The second top panel 32 comprises a second top handle 38. Since the first handle and the second handle are identical, as shown in FIG. 2, only handle 36 will be described in detail with reference to FIG. 3.

The handle 36 comprises a first base block portion 46, a second base block portion 48, and a handle portion 44. The handle portion extends from each of the first and second base block portions.

The handle comprises two bottom edges 50, 64. The handles are attached to the panel 28 and bendable relative to the rest of the panel 28 at the bottom edges 50, 64. Perpendicular to the bottom edge 50 are a first side edge 46 and a second side edge 54. Perpendicular to bottom edge 64 is a third side edge 66 and a forth side edge 68. Opposite the bottom edge 50 is an optional bend line 51. Opposite bottom edge 64 is an optional bend line 65. The first base block 46 is defined by bottom edge 50, sides 52, 54, and bend line 51. The second base block 48 is defined by the bottom edge 64, sides 66, 68, and bend line 65. The bottom edges 50, 64 may be bend locations without any predetermined or predefined scoring or perforation.

Figure 3:
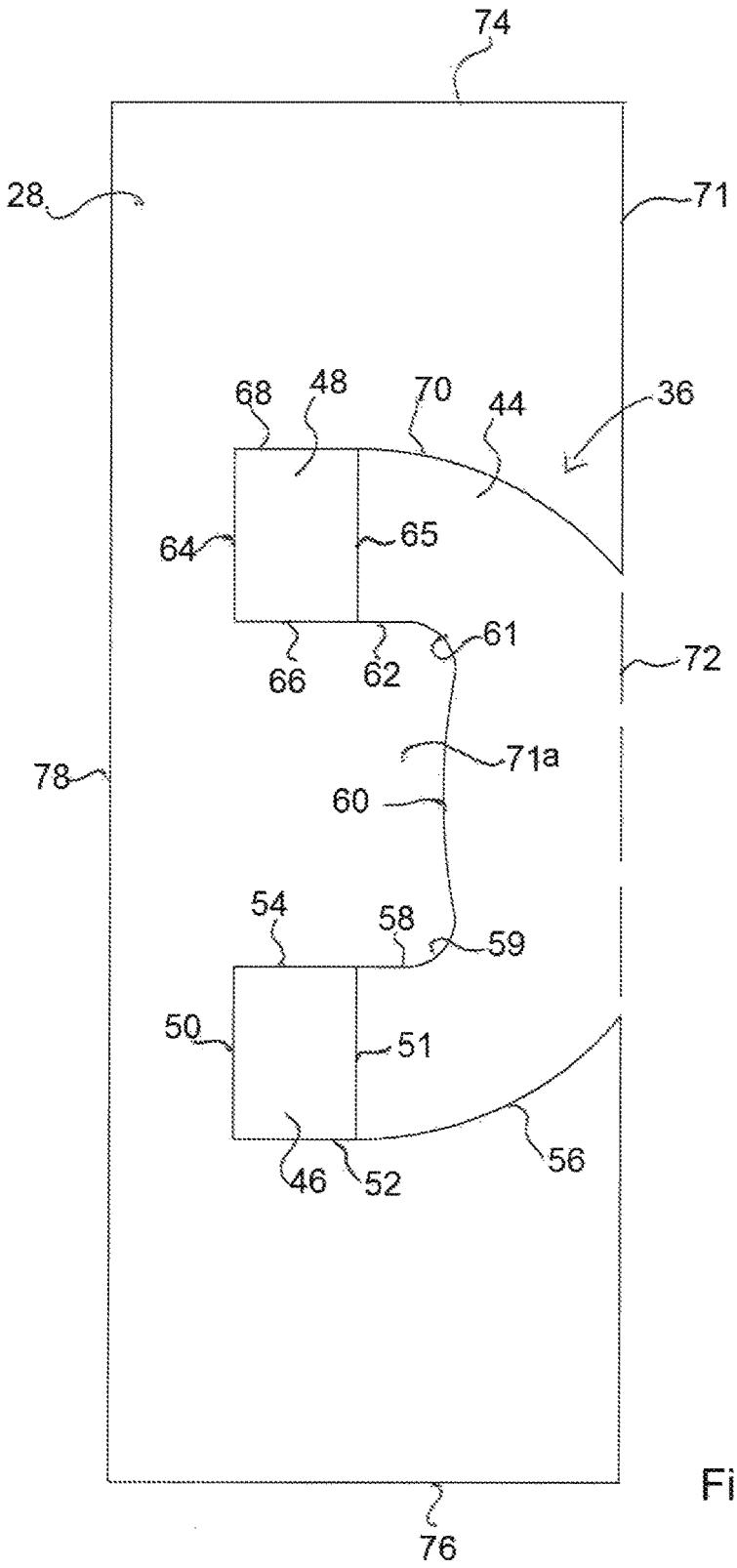
FIG. 3 is a top view of a top panel of the container of FIG. 1.

The handle portion comprises a first outer curved side 56, a second outer curved side 70, and an end portion 72 connecting the first outer curved side in the second outer curved side. The handle portion 44 further comprises a first inner side portion 58, a second inner portion 60, third inner side portion 62. The first inner sidewall portion 58 is aligned with and connected to the second side edge 54. The third inner side portion 62 is connected and aligned with the third side edge 66. In some embodiments, the second inner portion 60 is curved as shown in FIG. 3. In some embodiments, a first curved corner 59 joins the first inner sidewall portion 58 and the second inner portion 60. In some embodiments, a second curved corner 61 joins the third inner side portion 62 and the second inner portion 60. In some embodiments, the end portion 72 is aligned or co-planer with the edge 71 of panel 28. While a generally curved handle portion with straight block portions is shown, other handle shapes could be used.

FIG. 4 shows the box 10 with the handles in a raised position. In the deployed position, the handles 36, 38 are raised from the stored position where the handles within handle recesses 80, 82. In some embodiment, the handles are co-planar or substantially co-planer with the panels 28, 32 when in the stored position. In some embodiments, the handles are embedded in the panels 28, 32 when in the stored position.

The handles may be moved to the raised position from the stored position by pressing with a user's hand or fingers the lower area 71*a* of the panel adjacent portion 60 of the handle. Then sliding one or more fingers, as shown in FIG. 1, under the handle 36 and pulling the handle upward and pivoting it to the raised position.

When the handles is moved to the raised position, the handle 36 is raised from panel 28 so that a first handle recess 80 is left in the panel 28. The handle 38 is raised from the panel 32 so that a second handle recess 82 is left in the panel 32. The handles 36, 38 are pivoted upwards towards each other by the user. Once they are raised sufficiently high so an open area 84 underneath each is available, a user can place user's hand in the open area 84 and grasp both of the handles together from the bottom of each handle, for example at the second inner portion 60. The box can be carried by a user's hand grasping one or both handles and lifting the handles and therefore the box. The handle 36 pivots at bottom edges 50, 64 relative to the remainder of the panel 28. Handle 38 pivots in the same manner with respect to panel 32.

Figure 5:
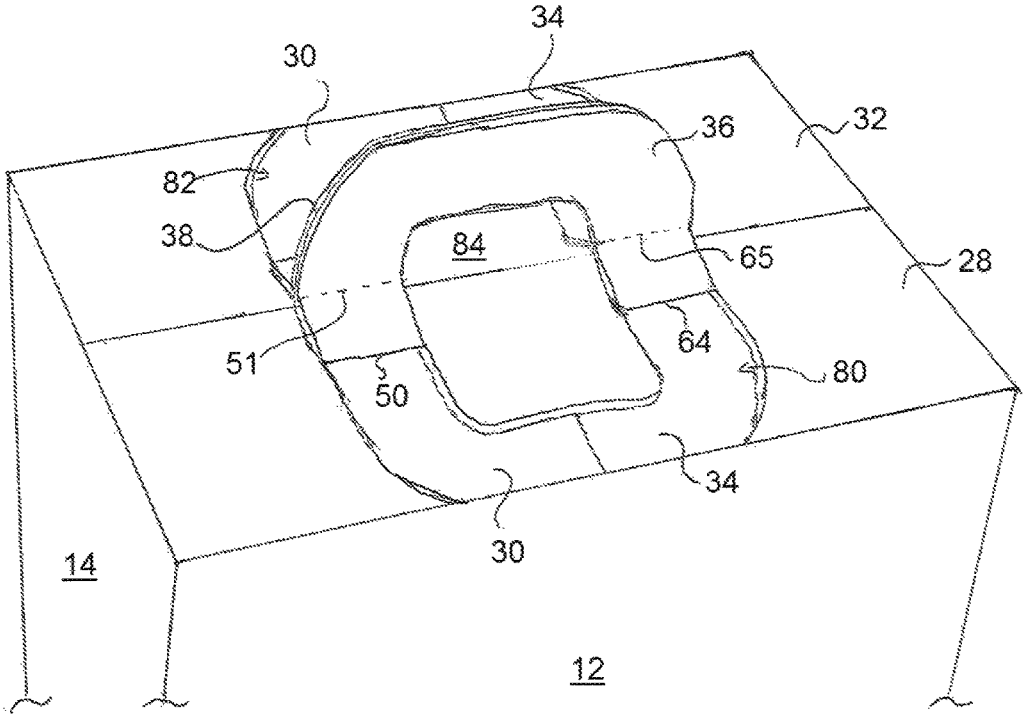
FIG. 5 is a perspective view of the container of FIG. 1 comprising handles in a second raised position.

In some embodiments, the handles 36, 38 can each bend at the bend lines 51, 65 (not labeled for handle 38), so that the handle portion 44 of each handle 36, 38 are aligned next to each other. In some embodiments, the handle portion 44 of each handle 36, 38 are substantially parallel or substantially vertical in the raised position. The base blocks 46, 48 of handle 36 can be angled towards the base blocks of handle 38 as shown in FIG. 5. Allowing the handle portion 44 of each handle 36, 38 two the aligned next to each other allows for a compact configuration of the handles which may be more easily grasped by the user. When the handles are under load by lifting the box, the handle portion 44 of each handle may separate or partially separate from the other so that the bend at the bend lines is eliminated or partially eliminated and the handles extend from the box in a straight or more straight fashion, such as shown in FIG. 4, than they had been when the handle portions 44 of each handle 36, 38 were aligned in surface to surface contact next to each other. It will be recognized that the bend lines 51, 65 may merely be a crease or may form automatically upon the user grasping the handles together or during regular use. In some embodiments, the handles do not have bend lines and do not bend at an intermediate location along the handle.

When the handles are in the deployed position, the box is easily carried in one hand at the adjacent handles 36, 38.

When the handles 36, 38 are no longer needed in the raised position, the user can pivot each handle down so that it is received in the recess 80, 82. When moving from the raised to the stored position, the handles are pivoted about the bottom edge 50, 64.

Figure 6:
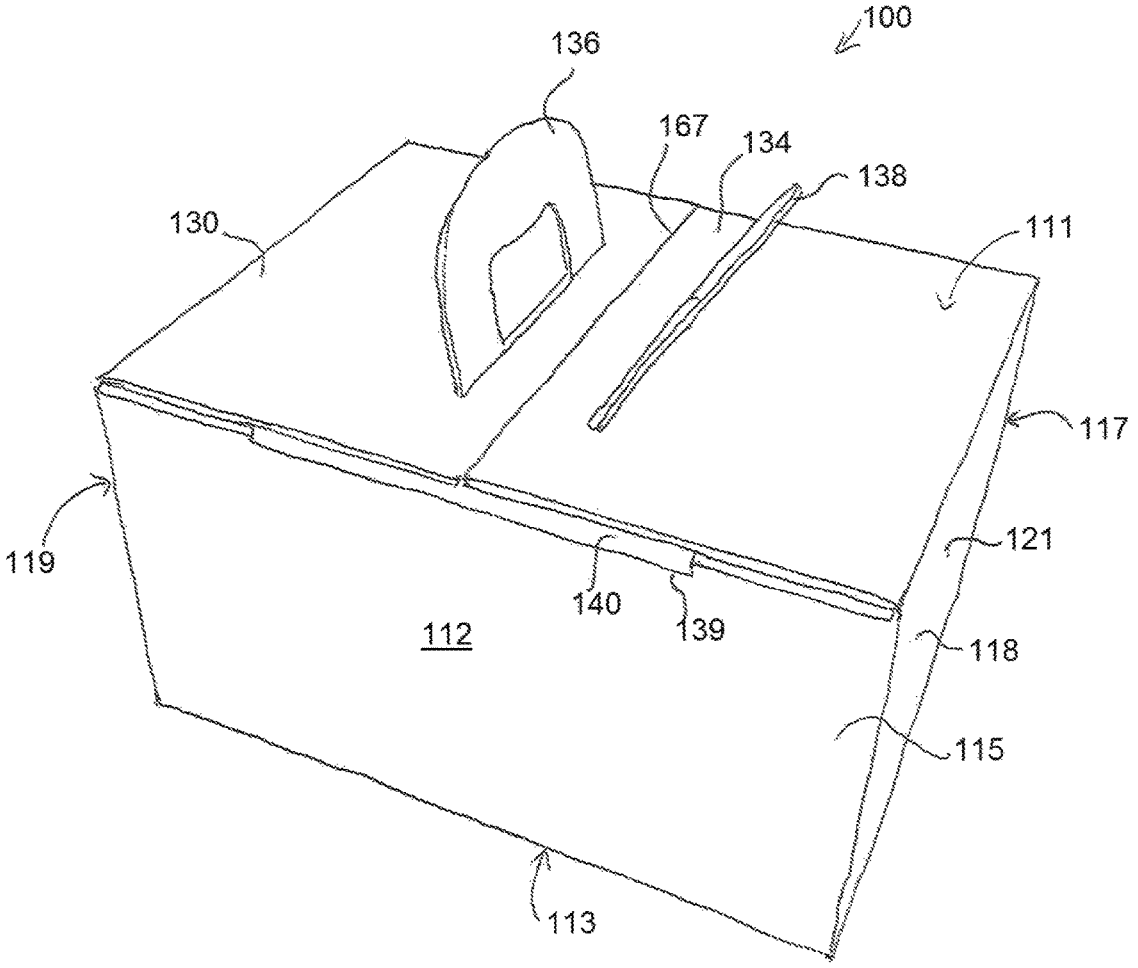
FIG. 6 is a perspective view of a second embodiment container.

FIG. 6 shows a second embodiment container or box 100 comprising handles. The box 100 comprises a top side 111, a bottom side 113, a front side 115, a back side 117, a left side 119, and a right side 121. The front side comprises a front panel 112. The backside comprises a back panel 116. The left side 119 comprises a left panel 114. The right side 121 comprises a right panel 118. While sides 115, 117, 119, 121 have been labeled front side, backside, left side, and right side, respectively, it will be recognized that other designations for those sides are allowed. For example, what has been labeled front side could be considered the backside and all other sides relabeled accordingly. As a further example, what has been labeled the left side could be considered the front side and all other sides relabeled accordingly. Therefore, the user or the application or the particular container configuration can determine whether or not a particular side is labeled a front side, a backside, a left side, or a right side.

Figure 7:
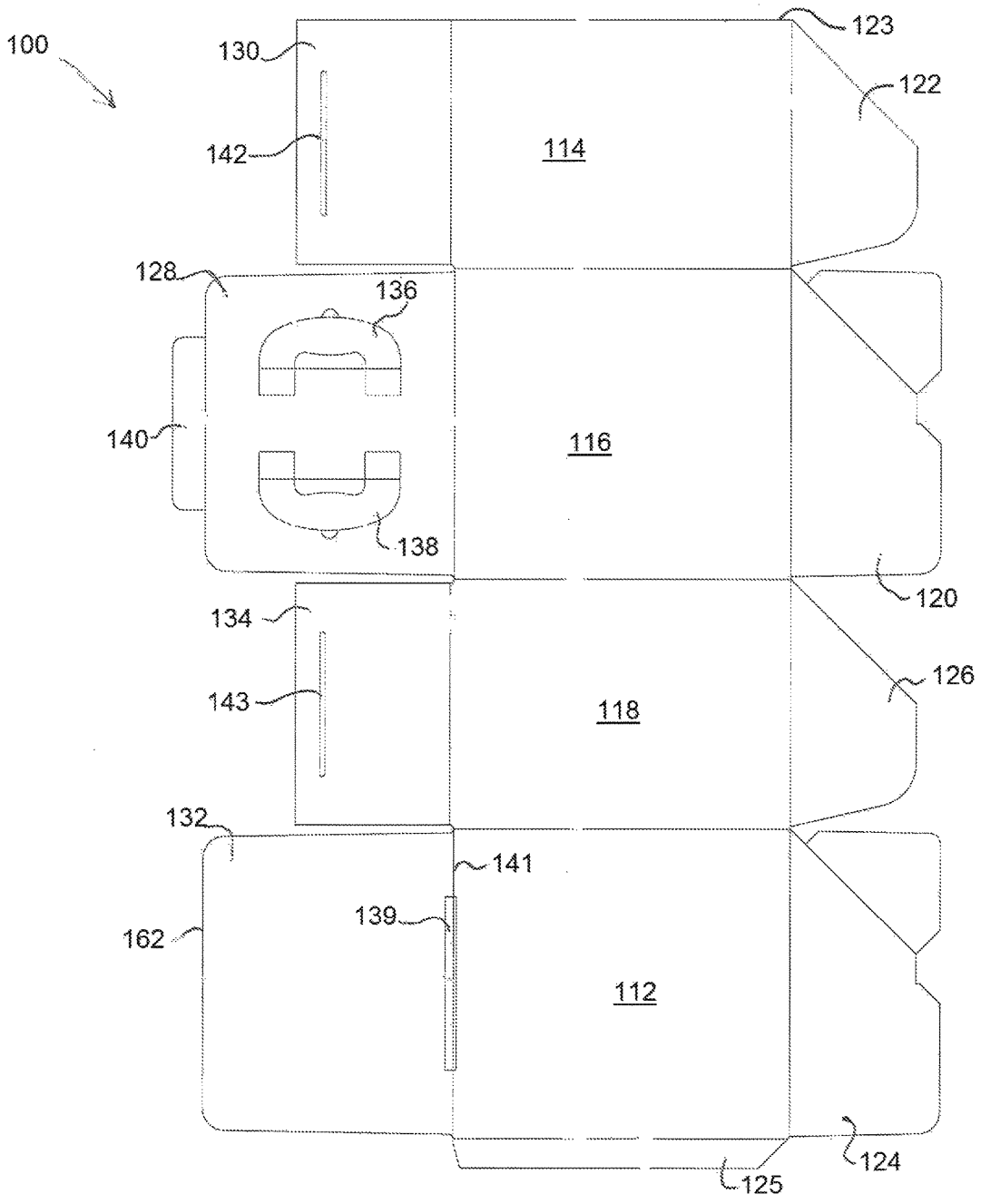
FIG. 7 is a top view of the container of FIG. 6 in a flat configuration.

FIG. 7 shows the box 100 in a flat configuration where panel 112 has been disconnected from panel 114. To convert the box from the flat configuration to a box configuration the tab 125 may be affixed to an inside surface or an outside surface of the panel 114 at or adjacent edge 123. The bottom panels 122, 126, 120, 124 are folded down, typically until the bottom panels are substantially perpendicular to the side walls of the box. The bottom side 113 comprises the first bottom panel 120 and a second bottom panel 124. Third bottom panel 122 and forth bottom panel 126 may be folded under bottom panel 120 and bottom panel 124 to provide support to panels 120 and 124. In some embodiments all of or a portion of panels 122 and 126 are visible from the bottom when the box is in the box configuration.

Figure 8:
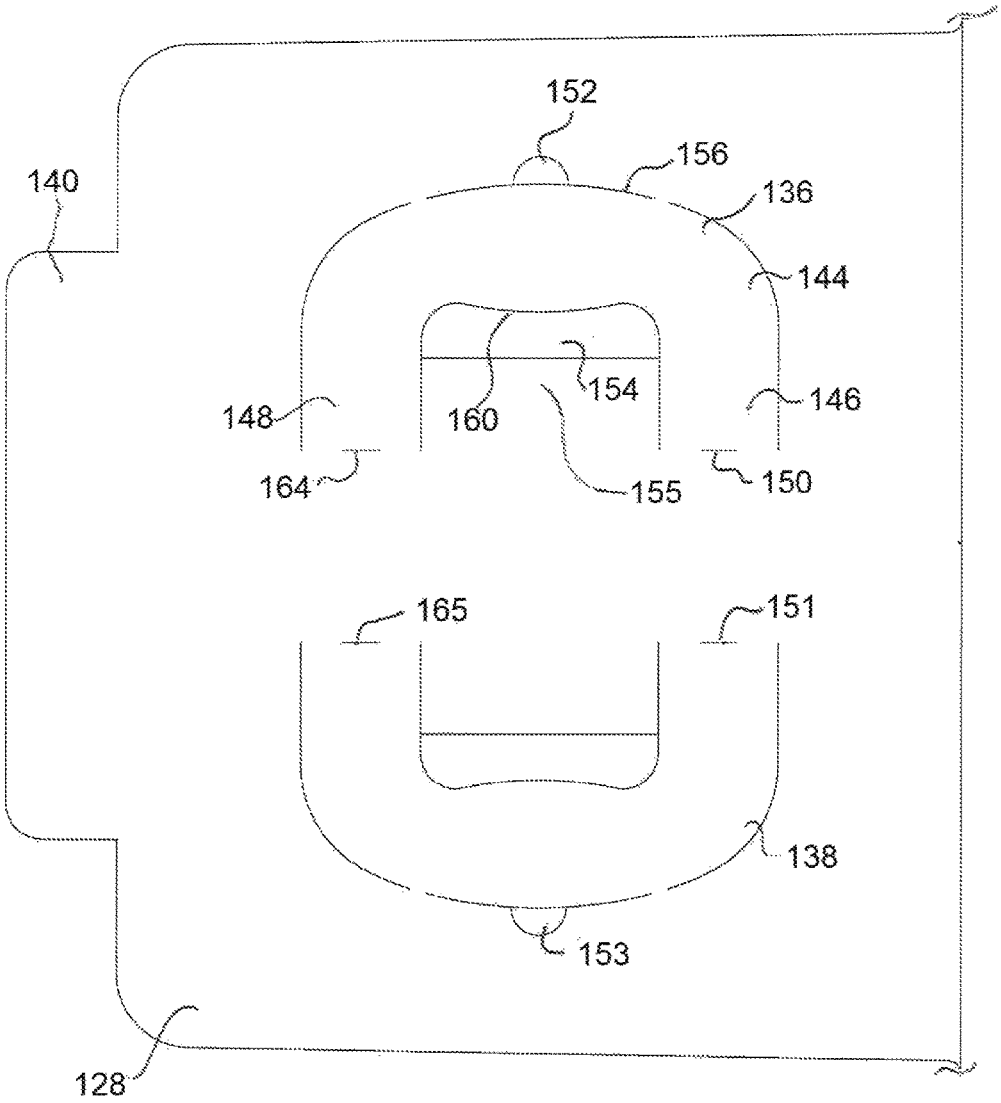
FIG. 8 is a top view of a top panel of the container of FIG. 6.
Figure 9:
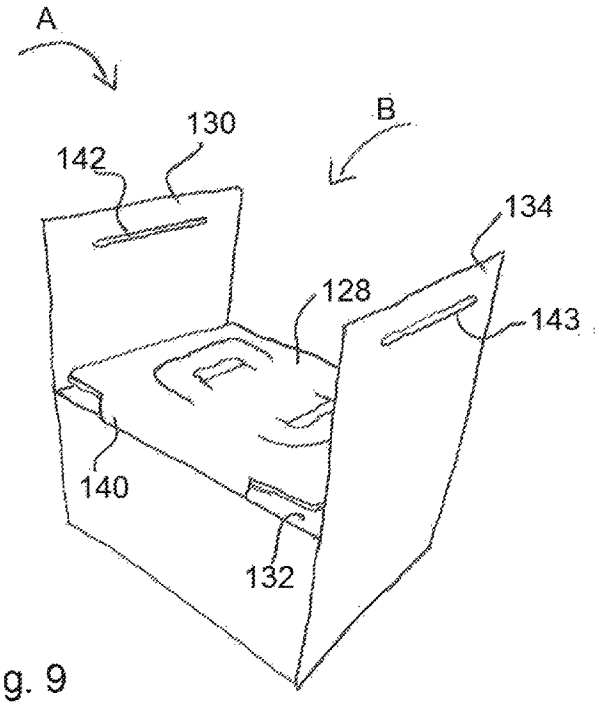
FIG. 9 is a perspective view of the container of FIG. 6 where the top panels of the container are in a stage of closure.

The top side 111 comprises a first top panel 130 and a second top panel 134. As shown in FIGS. 6, 8, and 9, when the box 100 is in a box configuration a third top panel 128 and a fourth top panel 132 are located beneath the first top panel 130 and the second top panel 134.

The third top panel 128 comprises a first top handle 136 and a second top handle 138. The third top panel 128 comprises a front tab 140. The first top panel 130 comprises a first handle slot 142. The second top panel 134 comprises a second handle slot 143. The fourth top panel 132 comprises a tab slot 139 at or about the fold line 141 between panel 132 and panel 112.

Handle 136 comprises a first base block portion 146, a second base block portion 148, and a handle portion 144. The handle portion 144 extends from each of the first and second base block portions. The handle portion comprises a curved outer edge 156 and a curved inner edge 160 similar to the second inner portion 60. Adjacent a center of the curved outer edge is a finger recess 152 configured to receive a user's finger so that the user can pivot the handle 136 upward and away from the panel 128. Adjacent the handle opposite the finger recess is a bottom side opening 154. The bottom side opening can be used in the same manner as the finger recess to enable the user to grab the handle when it is in the stored position. In some embodiments, there is no bottom side opening 154. Handle 138 is identical to handle 136, but is rotated 180 degrees from handle 136 and is spaced apart from handle 136 as shown in FIGS. 7 and 8.

Figure 10:
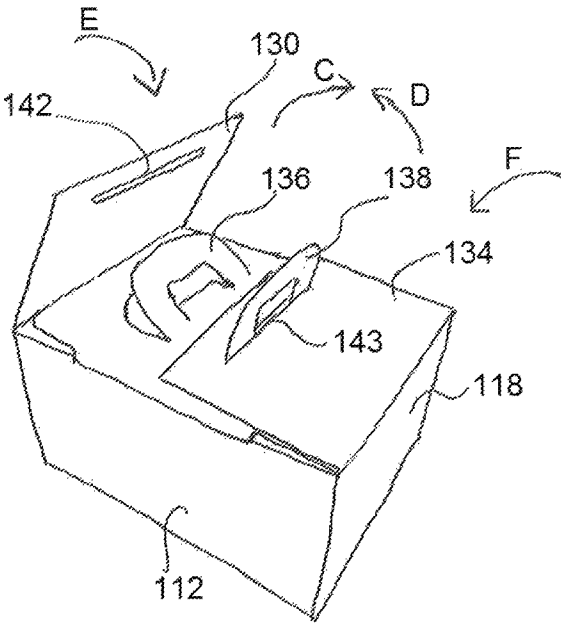
FIG. 10 is a perspective view of the container of FIG. 6 where the top panels of the container are in a second stage of closure.

FIGS. 6, 9, and 10, show the box in various stages of closure. To close the box, panel 132 is folded down in direction A of FIG. 9 so that the back edge 162 is at or adjacent panel 116. The panel 132 may then be horizontal or substantially horizontal. Then panel 128 is folded down in the direction B of FIG. 9 so that it overlaps panel 132. The front tab 140 is inserted into tab slot 139 to secure the panel 132 relative to panel 128. The panel 132 may be in surface-to-surface contact with panel 128 when in the down position.

Next the user lifts each handle 136, 138 into a raised position. The handles pivot at bend locations 150, 164, 151, 165 in the directions C and D, respectively. The user may use the finger recesses 152, 153 to grab each handle and move it from the stored position to the raised position. In the raised position, the handles are transverse to the panel 128. In some embodiments or uses, in the raised position, the handles may be vertical or substantially vertical. In some embodiments or uses, in the raised position, the handles are at a right angle to the panel 128.

Next, panels 130, 134 are folded down in the directions E and F of FIG. 10, respectively, so that the panels overlap portions of panel 128 as shown in FIG. 6. When the panels 130, 134 are in the process of being folded down, the top of the handles 136, 138 are aligned with the slots 142, 143. Then, panels 130, 134 are moved down over the handles so that the handles are received in the slots as is shown in FIGS. 6 and 10. The overlap of the panels 130, 134 at and about the base of the handles 136, 138 imparts additional strength to the handles to prevent the handles from tearing away from the panel 128 under certain loads. The panels 130, 134 can be folded down substantially simultaneously or in series one after another.

When the panels 130, 134 are folded down to the closed position and the handles extend through the slots 130, 134, the handles 136, 138 can have a range of motion toward (in directions C and D, respectively, of FIG. 10) and away from each other. The range of motion may be limited by the slot or the handles may bend at the intersection of the slot and the handle. In some uses, a top portion of each handle 136, 138 is in contact with a top portion of the other handle 136, 138 when the user grasps the handles and/or lifts the box with the handles, similar to the way that the handles 36, 38 contact in FIG. 4. In some embodiments, whether or not handles 136, 138 contact each other when grasped by the user, the handles are positioned sufficiently close to each other so that a user can grasp both handles through the openings 154 of each handle in one hand when the handles are in the raised position.

Tape or another adhesive may be applied to join panels 130, 134 at or about the seam 167. Tape or adhesive may be applied over tab 140 and down at least a portion of the panel 112. It may also be applied down at least a portion of the panel 116. In this way, panels 130, 134 are joined together and are joined by the tape or adhesive to panels 112 and 116.

To open the box 100, any tape or adhesive between panels 130, 134, 112, and 116 can be removed, cut, or released. The panels 130 and 134 are raised. In the process of being raised the handles are withdrawn from the slots 142, 143. Then the tab 140 is removed from the tab slot 139 and the panel 128 is raised. The handles can be folded to the stored position before or after panel 128 is raised. In some embodiments, when in the stored position, the handles are embedded in, or co-planar, or substantially co-planer with the panel 128 before or after the panel 128 is raised. Then, panel 132 is raised. Then all the panels 130, 128, 134, 132 are in a vertical or other raised position and the interior cargo area of the box 100 is accessible via an open top.

Figure 11:
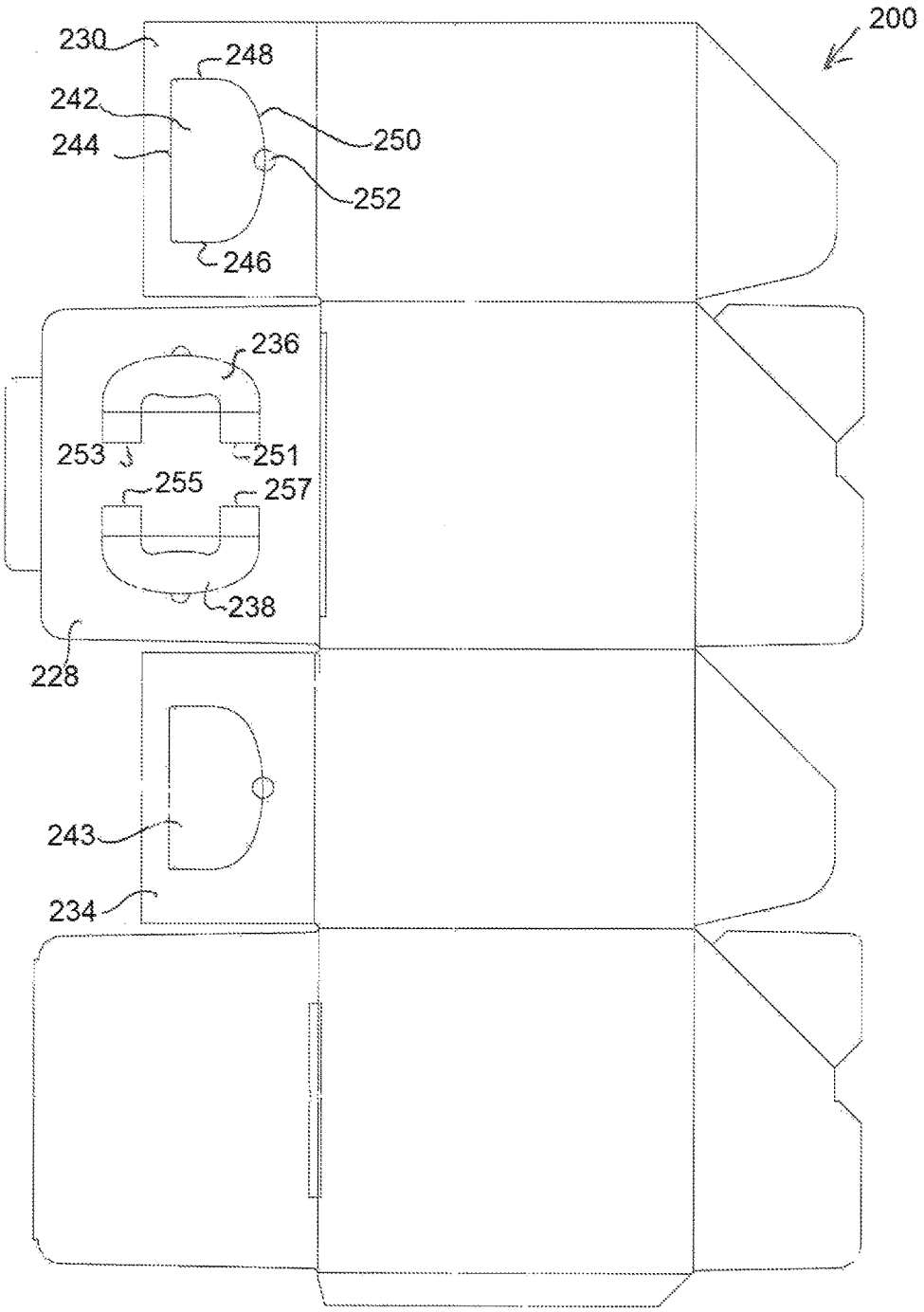
FIG. 11 is a top view of a third embodiment container in a flat configuration.

FIG. 11 shows a third embodiment box 200 in a flat configuration. The third embodiment box 200 is the same as the second embodiment box 100, except that the slots 142, 143 of the box 100 are replaced with handle openings 242, 243. In some embodiments, the handle openings comprise a D shape or a substantially D-shape. In some embodiments the handles openings 242 comprise a first straight side 244, a second straight side 246, a third straight side 248, and a curved portion 250. The second and third sides 246, 248 are perpendicular to the first side 244. Other shaped handle openings can be provided, such as square, rectangular, or irregular. The handle opening may match the shape of the handles 236, 238. The handle openings 242, 243 may be substantially the same size as the handles or they may be larger in one or more dimensions.

When the panels 230, 234 are folded down, in some embodiments, the handles 236, 238 need not be in the raised position. This is because the openings 242, 243 are large enough to allow the handles to move between the raised and lowered positions of the handles while the panels 230, 234 are folded down over panel 228.

While the drawings show that the boxes 10, 100, 200 each comprise two handles, in some embodiments, the top of each box has only one handle. In some embodiments, while the top of the box may comprises two handles, the user might only use one of the two handles to lift the box.

The handles may be formed in the top panel(s) of the box by cutting the outline shape of the handles in the corresponding panel(s) and leaving a bottom connecting portion uncut, such as at 50, 64, for a pivoting attachment of the handle(s) to the corresponding panel(s). Therefore, the handles may comprise the same material as the attached panel and/or the remaining portions of the box.

The handles may be cut into the top panel(s) at the same time as the entire container, or a portion of the container is being cut.

The container(s) 10, 100, 200 may be made by taking sheet(s) of material and feeding it into a machine having a roller die cutter. The sheet material is cut where the dies on the roller meet the material. The sheet may leave the roller die cutter having the perimeter, such as shown in FIGS. 2, 7, and/or 11, cut by the die(s). One or more dies may be placed on the roller so as to cut the handles at the same time as the perimeter of the box is cut from the sheet(s) of material. The roller may also comprise scoring elements. The scoring elements may be placed to score, but not cut, the container in places where it is desired to allow the user to fold or bend the resulting container, such as at the edge of a flap or panel, or the bottom of the handles. The scoring allows the material to be more easily bent by the user in predefined locations.

A method of manufacturing a container is provided. A plurality of cutting dies are mounted to a roller. Optionally one or more scoring elements are also mounted to the roller. The cutting dies and scoring elements are mounted to and positioned on the roller so that when the roller rolls over a sheet(s) of material, the dies will cut the sheet(s) and the scoring elements will score the sheets in predefined locations. When corrugated fiberboard is used, a sheet of corrugated fiberboard is feed toward the roller. The sheet is supported by a conveyor or a stationary lower support surface. The roller rolls over the sheet, or the sheet rolls under the roller, and the dies cut the sheet in the locations where the dies meet the sheet. The scoring elements score the sheet in the places where the scoring elements meet the sheet. When the sheet is away from the roller, the sheet will have the perimeter desired and set on the roller, such as the perimeter of the containers shown in FIG. 2, 7, or 11. In addition, the handles 36, 38, 136, 138, 236, 238, slots 142, 143, 139, and openings 242, 243 will have been cut by the dies. Further, the folding locations, such as 50, 64, 150, 164, 151, 165, 251, 253, 255, 257, will have been scored by the scoring elements.

Another method of manufacturing a container using a flatbed die cutter is provided. A plurality of cutting dies are mounted to a die mount. Optionally one or more scoring elements are also mounted to the die mount. The cutting dies and scoring elements are mounted to and positioned on the die mount so that when the die mount is lowered onto a sheet(s) of material, the dies will cut the sheet(s) and the scoring elements will score the sheets in predefined locations. When corrugated fiberboard is used, a sheet of corrugated fiberboard is placed on a support, such as a flat support. The die mount is lowered over the sheet and the dies cut the sheet in the locations where the dies meet the sheet. The scoring elements score the sheet in the places where the scoring elements meet the sheet. Then the die mount is lifted from the sheet or the sheet is lowered from the die mount. Then the resulting sheet will have the perimeter desired and as set on the die mount, such as the perimeter of the containers shown in FIG. 2, 7, or 11. In addition, the handles 36, 38, 136, 138, 236, 238, slots 142, 143, 139, and openings 242, 243 will have been cut by the dies. Further, the folding locations, such as 50, 64, 150, 164, 151, 165, 251, 253, 255, 257, will have been scored by the scoring elements.

A further method of manufacturing a container is provided. A sheet is placed on a cutting table. A milling device, with a rotating milling bit is mounted over the cutting table. The milling device is mounted on a moving mechanism that can move the milling device in at least the lateral and longitudinal directions relative to the sheet on the cutting table. The moving mechanism is controlled by a controller or a computer. The depth of the milling device/milling bit may also be controlled by the controller or computer. A design, such as the design of the container shown herein, may be loaded into the controller or computer. Then the computer causes the moving mechanism to move the milling device relative to the sheet/cutting table. The computer will cause the milling device or milling bit to move downward to engage the sheet, then it will cause the moving mechanism to move the milling device to cause cuts and/or scores to be made in or on the sheet. Then the resulting sheet will have the perimeter desired and set in the controller or computer, such as the perimeter of the containers shown in FIG. 2, 7, or 11. In addition, the handles 36, 38, 136, 138, 236, 238, slots 142, 143, 139, and openings 242, 243 will have been cut by the milling device. Further, the folding locations, such as 50, 64, 150, 164, 151, 165, 251, 253, 255, 257, will have been scored by the scoring elements. Other known cutting or scoring elements can be mounted to the moving mechanism and used in place of the milling device for achieving cuts or scoring in the sheet. A still further method of manufacturing a container is provided where some or all of the cuts and scoring on the sheet are made by hand or hand tools.

While box shapes are shown in the drawings, it will be appreciated that the handles can be implemented in a top side panel or surface of containers of other shapes, such as containers having more or fewer sides than the boxes shown, or containers having angled sides, or on cylindrical containers. The boxes/containers and portions thereof may comprise any desirable dimensions and may be sized to suit a given application. In some embodiments, the boxes/containers comprise a square shape or a rectangle shape.

Figure 12:
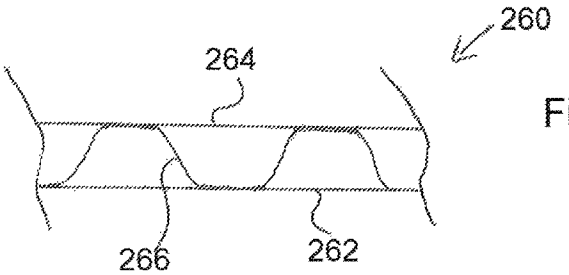
FIG. 12 is a fragmentary cross-section of a corrugated fiberboard usable in a container of the invention.

In some embodiments, the container/box 10, 100, 200 is made out of corrugated fiberboard, containerboard, paperboard, cardboard, chipboard, or plastic. In some applications, corrugated fiberboard comprises a fluted corrugated sheet and one or two flat linerboards. In some applications, the corrugated sheet and the linerboards are made of a containerboard, which may be a paperboard material. In some embodiments the containerboard comprises a thickness of more than 0.01 inches. An exemplary fragmentary cross-section of one type of corrugated fiberboard is shown in FIG. 12. The fluted corrugated sheet 266 is located between a first flat liner board 262 and a second flat liner board 264.

From the foregoing, it will be observed that numerous variations and modifications may be effected without departing from the spirit and scope of the invention. It is to be understood that no limitation with respect to the specific apparatus illustrated herein is intended or should be inferred. For example, one or more component or embodiments may be combined, modified, removed, or supplemented to form further embodiments within the scope of the invention. As a further example, steps provided could be carried out in a different order to achieve desired results. Further, steps could be added or removed from the processes described. Therefore, other embodiments and implementations are within the scope of the invention.

The invention claimed is:

1. A corrugated fiberboard container, comprising:

a plurality of walls defining an interior cargo space; and, a first top panel pivotally connected to a first side wall of the plurality of walls and moveable between a raised position and a closed position, the first top panel is disposed over the cargo space when the first top panel is in a closed position, the first top panel comprises an integrated first handle, a first handle aperture, an integrated second handle, and a second handle aperture, the first handle aperture is configured to house the first handle, the first handle comprises a raised position and a stored position, the first handle is housed within the first handle aperture when in the stored position, and the first handle extends out of the first handle aperture and is transverse to the first top panel when in the raised position, the second handle aperture is configured to house the second handle, the second handle comprises a raised position and a stored position, the second handle is housed within the second handle aperture when in the stored position, and the second handle extends out of the second handle aperture and is transverse to the first top panel when in the raised position;

a second top panel pivotally connected to a second side wall of the plurality of walls and moveable between a raised position and a closed position, the second top panel is disposed over the cargo space when the second top panel is in the closed position, the second top panel comprises a first elongated slot configured to allow the first handle to extend through the second top panel at least when the first handle is in the raised position and the second top panel overlaps the first top panel in the closed position; and, a third top panel pivotally connected to a third side wall of the plurality of walls and moveable between a raised position and a closed position, the third top panel is disposed over the cargo space when the third top panel is in a closed position, the third top panel comprises a second elongated slot configured to allow the second handle to extend through the third top panel at least when the second handle is in the raised position and the third top panel overlaps the first top panel in the closed position, the first elongated slot comprises a first span in an elongated direction of the first elongated slot and a second span transverse to the elongated direction of the first elongated slot, the first span is sized to receive a width of the first handle and the second span is sized to receive a thickness of the first handle when the first handle is in the raised position, the second span is less than a height of the first handle;

the second elongated slot comprises a first span in an elongated direction of the second elongated slot and a second span transverse to the elongated direction of the second elongated slot, the first span is sized to receive a width of the second handle and the second span is sized to receive a thickness of the second handle when the second handle is in the raised position, the second span is less than a height of the second handle.

2. The container of claim 1, wherein the first handle is co-planer with the first top panel when the first handle is in the stored position.

3. The container of claim 1, wherein the first handle comprises substantially an inverted U-shape.

4. The container of claim 1, wherein the first span of the first elongated slot is substantially equal to the width of the first handle, the second span of the first elongated slot is substantially equal to the thickness of the first handle, the first span of the second elongated slot is substantially equal to the width of the second handle, and the second span of the second elongated slot is substantially equal to the thickness of the second handle.

5. The container of claim 1, wherein the first side wall is positioned ninety degrees from the second side wall; and the second side wall is opposite the third side wall.

6. The container of claim 1, wherein the second top panel and the third top panel are co-planer when each is in the closed position.

7. The container of claim 1, wherein the second top panel is adjacent the third top panel when each are in the closed position, the second top panel is joined to the third top panel by an overlapping adhesive strip when in the closed position.

8. The container of claim 1, wherein the first and second handles are positioned adjacent to each other such that both the first and second handles can be grasped in one hand of a user when the first and second handles are in the raised position.

9. The container of claim 1, wherein the second and third top panels each cover about half of the first top panel when each are in the closed position.

10. The container of claim 1, comprising a fourth top panel disposed over the cargo space when in a closed position; the first top panel overlaps the fourth top panel when each are in the closed position; the first top panel and the fourth top panel are pivotally connected to opposite sidewalls of the plurality of walls.

11. The container of claim 10, wherein a distal end of the first top panel comprises a tab, the tab is configured to be received in a corresponding slot of the fourth top panel when the first and forth panels are in the closed position.

12. The container of claim 1, wherein the first handle is in contact with the second handle when the first and second handles are each in the raised position.

13. The container of claim 1, wherein the first and second handles are co-planar when in the stored position.

14. The container of claim 1, wherein a first bottom of the first handle is spaced apart from a second bottom of the second handle, and a first upper portion of the first handle is in contact with a second upper portion of the second handle when the first and second handles are in the raised position.

15. The container of claim 1, wherein the first handle is co-planer with the first top panel when the second handle is in the stored position;

the second handle is co-planer with the first top panel when the second handle is in the stored position;

the first side wall is positioned ninety degrees from the second side wall;

the first handle is orientated 180 degrees from the second handle when the first and second handles are each in the stored position;

the second side wall is opposite the third side wall;

the second top panel and the third top panel are adjacent and co-planer when each is in the closed position;

the second and third top panels each cover about half of the first top panel when each are in the closed position;

the container comprises a fourth top panel pivotally connected to a fourth side wall of the plurality of walls and moveable between a raised position and a closed position, the fourth top panel is disposed over the cargo space when the fourth top panel is in a closed position, the first top panel overlaps the fourth top panel when each are in the closed position, the first side wall is opposite of the fourth side wall;

the first top panel is above the fourth top panel and the second and third top panels are above the third top panel when each panel is in the closed position; and, the first span of the first elongated slot is equal to the width of the first handle, the second span of the first elongated slot is equal to the thickness of the first handle, the first span of the second elongated slot is equal to the width of the second handle, and the second span of the second elongated slot is equal to the thickness of the second handle.

16. A corrugated fiberboard box, comprising:

at least five walls defining an interior cargo space; and, a first top panel pivotally connected to a first side wall of the at least five walls and moveable between a raised position and a closed position, the first top panel is disposed over the cargo space when the first top panel is in a closed position, the first top panel comprises an integrated first handle, a first handle aperture, an integrated second handle, and a second handle aperture, the first handle aperture is configured to house the first handle, the first handle comprises a raised position and a stored position, the first handle is housed within the first handle aperture when in the stored position, and the first handle extends out of the first handle aperture and is transverse to the first top panel when in the raised position, the second handle aperture is configured to house the second handle, the second handle comprises a raised position and a stored position, the second handle is housed within the second handle aperture when in the stored position, and the second handle extends out of the second handle aperture and is transverse to the first top panel when in the raised position;

a second top panel pivotally connected to a second side wall of the at least five walls and moveable between a raised position and a closed position, the second top panel is disposed over the cargo space when the second top panel is in a closed position, the second top panel comprises a third handle aperture configured to allow the first handle to extend through the second top panel at least when the first handle is in the raised position and the second top panel overlaps the first top panel in the closed position; and, a third top panel pivotally connected to a third side wall of the at least five walls and moveable between a raised position and a closed position, the third top panel is disposed over the cargo space when the third top panel is in a closed position, the third top panel comprises a fourth handle aperture configured to allow the second handle to extend through the third top panel at least when the second handle is in the raised position and the third top panel overlaps the first top panel in the closed position;

the first elongated slot comprises a first span in an elongated direction of the first elongated slot and a second span transverse to the elongated direction of the first elongated slot, the first span is sized to receive a width of the first handle and the second span is sized to receive a thickness of the first handle when the first handle is in the raised position, the second span is less than a height of the first handle;

the second elongated slot comprises a first span in an elongated direction of the second elongated slot and a second span transverse to the elongated direction of the second elongated slot, the first span is sized to receive a width of the second handle and the second span is sized to receive a thickness of the second handle when the second handle is in the raised position, the second span is less than a height of the second handle.

17. The box of claim 16, wherein the first span of the first elongated slot is substantially equal to the width of the first handle, the second span of the first elongated slot is substantially equal to the thickness of the first handle, the first span of the second elongated slot is substantially equal to the width of the second handle, and the second span of the second elongated slot is substantially equal to the thickness of the second handle.

18. A paperboard box, comprising:

at least five walls defining an interior cargo space; and, a first top panel pivotally connected to a first side wall of the at least five walls and moveable between a raised position and a closed position, the first top panel is disposed over the cargo space when the first top panel is in a closed position, the first top panel comprises an integrated first handle, a first handle aperture, an integrated second handle, and a second handle aperture, the first handle aperture is configured to house the first handle, the first handle comprises a raised position and a stored position, the first handle is housed within the first handle aperture when in the stored position, and the first handle extends out of the first handle aperture and is transverse to the first top panel when in the raised position, the second handle aperture is configured to house the second handle, the second handle comprises a raised position and a stored position, the second handle is housed within the second handle aperture when in the stored position, and the second handle extends out of the second handle aperture and is transverse to the first top panel when in the raised position;

a second top panel pivotally connected to a second side wall of the at least five walls and moveable between a raised position and a closed position, the second top panel is disposed over the cargo space when the second top panel is in a closed position, the second top panel comprises a first elongated slot configured to allow the first handle to extend through the second top panel at least when the first handle is in the raised position and the second top panel overlaps the first top panel in the closed position; and, a third top panel pivotally connected to a third side wall of the at least five walls and moveable between a raised position and a closed position, the third top panel is disposed over the cargo space when the third top panel is in a closed position, the third top panel comprises a second elongated slot configured to allow the second handle to extend through the third top panel at least when the second handle is in the raised position and the third top panel overlaps the first top panel in the closed position the first elongated slot comprises a first span in an elongated direction of the first elongated slot and a second span transverse to the elongated direction of the first elongated slot, the first span is sized to receive a width of the first handle and the second span is sized to receive a thickness of the first handle when the first handle is in the raised position, the second span is less than a height of the first handle;

the second elongated slot comprises a first span in an elongated direction of the second elongated slot and a second span transverse to the elongated direction of the second elongated slot, the first span is sized to receive a width of the second handle and the second span is sized to receive a thickness of the second handle when the second handle is in the raised position, the second span is less than a height of the second handle;

the second side wall is opposite the third side wall, each of the second top panel and the third top panel extend for less than a distance between the second side wall and the third side wall.

19. The box of claim 18, wherein the first span of the first elongated slot is substantially equal to the width of the first handle, the second span of the first elongated slot is substantially equal to the thickness of the first handle, the first span of the second elongated slot is substantially equal to the width of the second handle, and the second span of the second elongated slot is substantially equal to the thickness of the second handle.

* * * * *